US006786027B2

(12) United States Patent
Oda et al.

(10) Patent No.: US 6,786,027 B2
(45) Date of Patent: Sep. 7, 2004

(54) OPERABLE SEALING MECHANISM FOR A STRAPPING BAND

(75) Inventors: Katsumi Oda, Yokohama (JP); Tetsuya Hoshino, Yokohama (JP); Shuichi Kikuchi, Yokohama (JP)

(73) Assignee: Nichiro Kogyo Co., Ltd., Yokohama (JP)

( * ) Notice: Subject to any disclaimer, the term of this patent is extended or adjusted under 35 U.S.C. 154(b) by 0 days.

(21) Appl. No.: 10/372,251

(22) Filed: Feb. 25, 2003

(65) Prior Publication Data

US 2003/0159409 A1 Aug. 28, 2003

(30) Foreign Application Priority Data

Feb. 26, 2002 (JP) ..... 2002-050575

(51) Int. Cl.[7] ..... B65B 13/22
(52) U.S. Cl. ..... 53/589; 100/32; 100/33 PB
(58) Field of Search ..... 100/26, 29, 32, 100/33 PB; 53/589, 399, 389.4

(56) References Cited

U.S. PATENT DOCUMENTS

| | | | | |
|---|---|---|---|---|
| 1,988,534 A | | 1/1935 | Abbott | |
| 3,327,618 A | | 6/1967 | Cook | |
| 3,577,909 A | | 5/1971 | Takano et al. | |
| 5,155,982 A | * | 10/1992 | Boek et al. | 53/589 |
| 5,287,802 A | * | 2/1994 | Pearson | 53/589 |
| 5,377,477 A | * | 1/1995 | Haberstroh et al. | 100/32 |
| 5,379,576 A | * | 1/1995 | Koyama | 53/589 |
| 5,791,238 A | * | 8/1998 | Garbotz | 100/32 |
| 6,035,774 A | | 3/2000 | Fischer | |
| 6,145,286 A | * | 11/2000 | Huber | 53/589 |
| 6,155,032 A | * | 12/2000 | Lai | 53/589 |

FOREIGN PATENT DOCUMENTS

| | | |
|---|---|---|
| DE | 2 225 297 | 12/1973 |
| DE | 296 21 737 | 5/1998 |
| FR | 1 183 082 | 7/1959 |

* cited by examiner

*Primary Examiner*—Louis Huynh
(74) *Attorney, Agent, or Firm*—Oblon, Spivak, McClelland, Maier & Neustadt, P.C.

(57) ABSTRACT

An engageable pawl member is provided so as to be swingable about a supporting shaft so that a pawl tip is movable along a moving path for a strapping band. The engageable pawl member is pulled forwardly in a swinging direction by a helical tension spring to push the pawl tip against the strapping band. The engageable pawl member shifts forwardly, following the movement of the strapping band in a feeding direction, and the strapping band is sandwiched and held between the engageable paw member and a holding guide. Then, the engageable pawl member follows the movement of the strapping band in a direction to pull back, and the engageable pawl member shifts backwardly so that the pawl tip moves in a direction out of the moving path for the strapping band.

4 Claims, 5 Drawing Sheets

OPERABLE SEALING MECHANISM FOR A STRAPPING BAND

BACKGROUND OF THE INVENTION (1) Field of the Invention

The present invention relates to an operable sealing mechanism for a strapping band, which is housed in a band type strapping machine to wind a strapping band around an article to be strapped and carry out a cutting and bonding operation for the strapping band.

(2) Description of Related Art

In band type strapping machines, an article to be strapped is strapped with a strapping band by annularly placing the strapping band around the article on a table, winding the strapping band around the article and carrying out the cutting and bonding operation. In some cases, an arch member is provided on the table to guide the strapping band for annularly placing the strapping band.

In order to wind the strapping band around the article and carry out the cutting and bonding operation, the operable sealing mechanism housed in a band type strapping machine includes a first gripper for holding a top end of a strapping band annularly placed around an article to be strapped; a band driving roller for feeding out the strapping band and winding the strapping band around the article by pulling back the strapping band to tension the strapping band when the top end of the strapping band is held; a second gripper for holding a rear portion of the strapping band wound around the article to keep the strapping band wound around the article; and a compression head for cutting the rear portion of the strapping band, and pushing and bonding (melt-bonding in most cases) the top end and the rear portion together, the strapping band being kept wound. The band driving roller is configured to be rotated by a band driving motor. The first gripper, the second gripper and the compression head are configured to be operated by driving cams, which are carried on a shaft for sealing rotated by a motor for sealing.

The band type strapping machine thus constructed is expensive since the machine includes two electric motors, i.e., the band driving motor for driving the band driving roller and the motor for rotating the shaft for sealing to operate the driving cams. In order to provide the band type strapping machine at low cost, it is preferable that the sealing mechanism is configured so that basic operations of the mechanism are carried out by a single driving motor.

BRIEF SUMMARY OF THE INVENTION

It is an object of the present invention to provide an operable sealing mechanism for a strapping band, which is configured to be capable of operations up to the cutting and bonding operation, being free from trouble, without using plural driving motors.

In order to attain the problem, the present invention provides an operable sealing mechanism comprising a first gripper for holding a top end of a strapping band, which is annularly placed around an article to be strapped; a band driving roller for feeding out the strapping band and winding the strapping band around the article by pulling back the strapping band to tension the strapping band when the top end of the strapping band is held; a second gripper unit for holding a rear portion of the strapping band wound around the article to keep the strapping band wound around the article; and a compression member or a compression head for cutting the rear portion of the strapping band, and pressing and bonding the top end and the rear portion together, the strapping band being kept wound; the second gripper unit including an engageable pawl holding unit; the engageable pawl holding unit comprising an engageable pawl member provided so as to be swingable along a moving path for the strapping band; a holding member provided on an opposite side of the engageable pawl member across the moving path for the strapping band; and a spring unit for urging the engageable pawl member forwardly in a swinging direction so as to press a pawl tip against the strapping band; wherein the engageable pawl member allows the strapping band to be pulled back and prevents the strapping band from being fed out in a feeding direction by sandwiching and holding the strapping band between the pawl tip and the holding member when a force for feeding the strapping band in the feeding direction is applied to the strapping band. Even the band driving roller is stopped on completion of the operation for winding the strapping band around the article, and when the winding keeping function of the band driving roller to the strapping band is released, the strapping band wound around the article can be prevented from loosening since the strapping band can not substantially move in the feeding direction. Even when the pawl tip is pressed against the strapping band prior to completion of the operation for winding the strapping band around the article, the engageable pawl member is no bar to pull back the strapping band since the engageable pawl member is configured to allow the strapping band to move in a direction to pull back. The operable sealing mechanism is normally provided with a heater for melting the top end and the rear portion of the strapping band.

In accordance with the present invention, the engageable pawl member is urged forwardly in the swinging direction, i.e. in a direction to feed out the strapping band by the spring unit, and the pawl tip is pressed against the strapping band. More specifically, the pawl tip is pressed against the strapping band after the strapping band has been fed out. When the strapping band starts moving in the feeding direction, i.e., when the strapping band makes a slight movement, the pawl tip also moves along with the strapping band in the feeding direction to shift the engageable pawl member forwardly, i.e., in the feeding direction since the pawl tip is urged in the feeding direction by the spring unit to be pressed against and engaged with the strapping band. When the engageable pawl member shifts forwardly, i.e., the pawl tip projects into the moving path for the strapping band or further projects into the moving path to narrow the gap between the pawl tip and the holding member, sandwiching and holding the strapping band between the pawl tip and the holding member. Conversely, when the strapping band moves in the direction to pull back, the pawl tip also moves in the direction to pull back along with the strapping band to shift the engageable pawl member backwardly, i.e., in the direction to pull back. When the engageable pawl member is shifted backwardly, the strapping band moves in the direction to pull back, being in frictional contact with the pawl tip, since, e.g., the pawl tip is configured to get out of the moving path for the strapping band in this time. The holding member may be provided by a guide forming the moving path for the strapping band for instance. The strapping band may move along the guide, being in contact with a guiding surface of the guide or being in sliding contact with the guiding surface.

The first gripper and the compression member or the compression head may be configured to be operated by a holding cam and a bonding cam, respectively, which are carried on the shaft for sealing. The shaft for sealing may be configured to be rotated by use of a band driving motor as a driving force, the band driving motor rotating the band driving roller.

The second gripper may be formed only by the engageable pawl holding unit. The grip head of the second grip, which is operated by the holding cam carried on the shaft for sealing and moves toward an opposing member, such as a seal anvil, to sandwich the rear portion of the strapping band along with the opposing member, may be formed as the swingable engageable pawl member. In this case, the second gripper is operated by the holding cam to sandwich and hold the strapping band between the opposing member and the second gripper while the grip head functions as the engageable pawl member to prevent the strapping band from shifting in the feeding direction. However, in order to reliably and continuously hold the strapping band up to completion of the operation for cutting and bonding the strapping band, and to avoid malfunction during the operation for holding the strapping band, it is preferable that the engageable pawl holding unit is formed independently from the second gripper. From this viewpoint, it is effective that the operable sealing mechanism for a strapping band comprising a first gripper for holding a top end of a strapping band, which is annularly placed around an article to be strapped; a band driving roller for feeding out the strapping band and winding the strapping band around the article by pulling back the strapping band to tension the strapping band when the top end of the strapping band is held; a second gripper for holding a rear portion of the strapping band wound around the article to keep the strapping band wound around the article; and a compression member or a compression head for cutting the rear portion of the strapping band, and pushing and bonding the top end and the rear portion together, the strapping band being kept wound; an engageable pawl holding unit further provided on a rear side of the second gripper, i.e., on a side of the second gripper facing a direction to pull back the strapping band; the engageable pawl holding unit comprising an engageable pawl member provided so as to be swingable along a moving path for the strapping band; a holding member provided on an opposite side of the engageable pawl member across the moving path for the strapping band; and a spring unit for urging the engageable pawl member forwardly in a swinging direction so as to press a pawl tip against the strapping band; wherein the engageable pawl member allows the strapping band to move in the direction to pull back and prevents the strapping band from being fed out in a feeding direction by sandwiching and holding the strapping band between the pawl tip and the holding member when a force for feeding the strapping band in the feeding direction is applied to the strapping band.

The second gripper and the compression member or the compression head may be configured to be operated by a holding cam and a bonding cam, respectively, which are carried on the shaft for sealing. The shaft for sealing may be configured to be rotated by use of a band driving motor as a driving force, the band driving motor rotating the band driving roller.

Now, an embodiment of the present invention will be described in reference to the accompanying drawings.

DETAILED DESCRIPTION OF THE INVENTION

Figure 1:
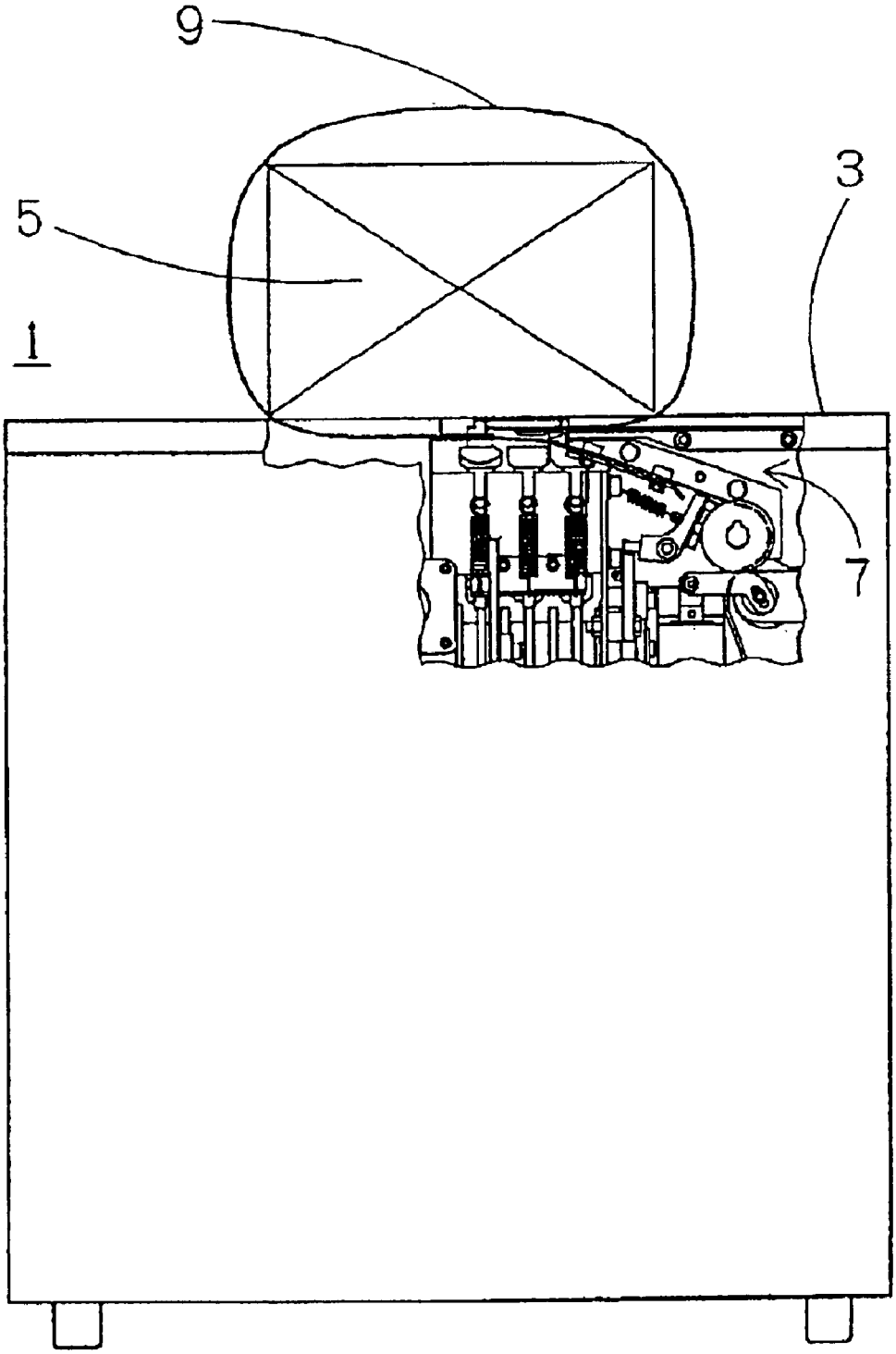
FIG. 1 is an overall schematic view showing a band type strapping machine including an operable sealing mechanism for a strapping band according to the present invention.
Figure 2:
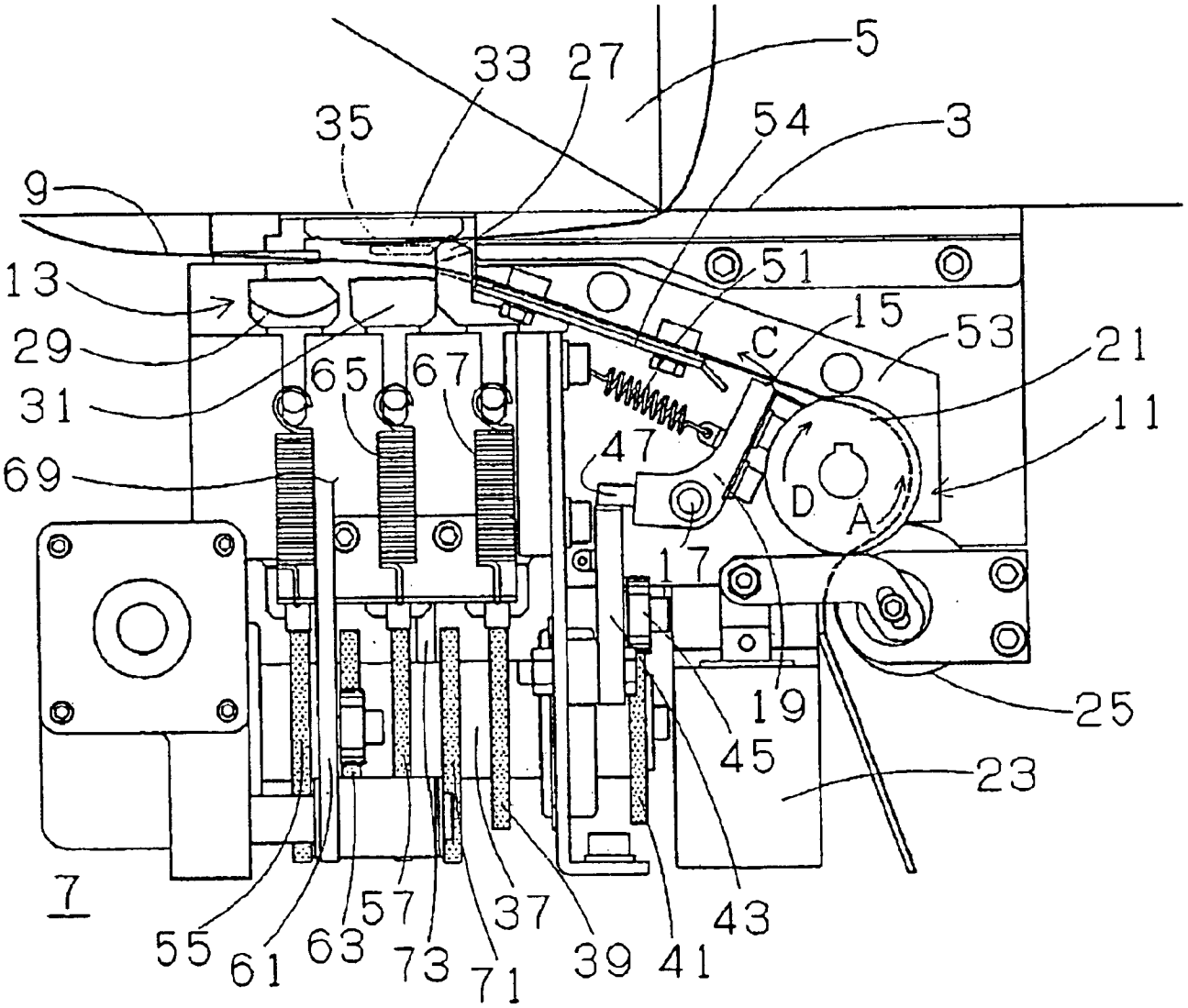
FIG. 2 is an enlarged view of the operable sealing mechanism for a strapping band.
Figure 3:
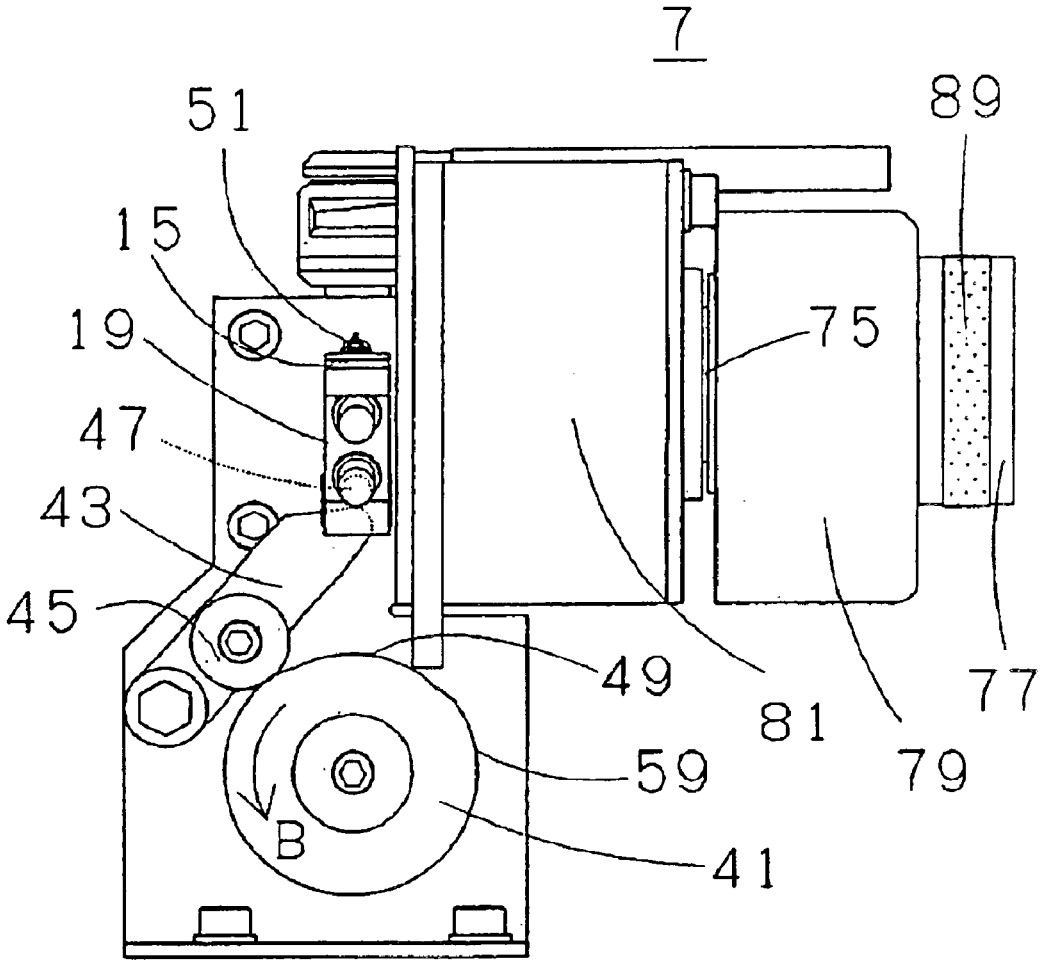
FIG. 3 is a slide view showing an engageable pawl member according to the present invention.

FIG. 1 is an overall schematic view showing a band type strapping machine including an operable sealing mechanism for a strapping band according to the present invention. FIG. 2 is an enlarged view of the operable sealing mechanism for a strapping band. FIG. 3 is a side view showing an engageable pawl member.

In the band type strapping machine 1, an article to be packed 5, which has been put on a table 3, is strapped by a strapping band 9, which has been fed out by a proper length from the operative sealing mechanism 7 for the strapping band. An operator manually places a preliminarily fed portion of the strapping band 9 around the article 5, and then, he or she inserts a top end of the strapping band 9 into the operative sealing mechanism 7 (as shown in FIG. 1), specifically, into a sealer 13 shown in FIG. 2 in detail. The top end of the strapping band 9, which has been inserted into the operative sealing mechanism 7, is automatically held. When the top end of the strapping band 9 has been held, the strapping band 9 is pulled back so as to be wound around the article 5. When the strapping band 9 has been wound around the article 5, the strapping band 9 is cut and melt-bonded, completing a strapping operation of the article 5.

The sealing mechanism includes a band driving roller unit 11 for feeding and pulling back the strapping band 9, the sealer 13 for securing the strapping band 9 and for cutting and melt-bonding the strapping band 9, the engageable pawl member 19, which is provided so as to be swingable about a supporting shaft 17 in order to be movable along a moving path for the strapping band 9 or to make a pawl tip 15 movable along the moving path for the strapping band 9 between the sealer 13 and the band driving roller unit 11. The band driving roller unit 11 includes a band driving roller 21 and a rocker roller 25, which is urged toward the band driving roller 21 so as to sandwich the strapping band 9 along with a lower side of the band driving roller 21 under the action of a solenoid plunger 23 (by contraction movement of the plunger), and which is moved away from the band driving roller 21 by a releasing action of the solenoid plunger 23 (by extension and release movement of the plunger). A portion of the strapping band 9, which has passed the rocker roller 25 urged toward the band driving roller 21, is wound around the band driving roller 21 and extends toward the sealer 13, passes the sealer 13 and is fed onto the table by a certain length by rotary movement of the band driving roller 21 in a counter-clockwise direction in FIG. 2 (see an arrow A).

The sealer 13 is configured to include a right gripper (first gripper) 27, a left gripper (second gripper unit or second gripper) 29, a compression member or compression head 31 provided between the right gripper 27 and the left gripper 29, a seal anvil or seal receiver 33, and a heater 35. When a top end detection switch (not shown) detects that the top end of the strapping band 9 fed onto the table by the certain length has been inserted into the sealer 13, or specifically, that the top end has been inserted so as to extend in a position from the right gripper 27 to the compression member 31 under the seal anvil 33, a shaft for sealing 37 for activating the sealer 13 is slightly rotated (see an arrow B in FIG. 3). The rotation of the shaft for sealing 37 causes a securing cam 39 carried on the shaft for sealing 37 to rotate and press the cam surface against the right gripper 27, raising the right gripper. As a result, the top end of the strapping band 9 is sandwiched and held between the right gripper 27 and the seal anvil 33.

The shaft for sealing 37 has a cam 41 for the engageable pawl carried thereon. The cam 41 has the cam surface contacting or supporting a follower ring 45 for an operable arm 43, which has a top end held in a raised releasing state. The top end of the operable arm 43 contacts or supports a rear portion 47 of the engageable pawl member 19. The engageable pawl member 19 is shifted backwardly since the rear portion 47 of the engageable pawl member is raised by the top end of the operative arm 43 in the releasing state. In this state, where the engageable pawl member 19 is shifted backwardly, the pawl tip 15 is no bar to feed the strapping band 9 onto the table since the pawl tip is located out of the moving path for the strapping band 9. As the shaft for sealing 37 rotates, the cam surface of the cam 41 for the engageable pawl has a recessed portion 49 gotten in contact with the follower ring 45 of the operable arm 43, bringing the operative arm 43 in an engaged state, wherein the top end of the operable arm is located at a lower position. Since the engageable pawl member 19 is pulled and urged forwardly in the swinging direction by a helical tension spring (spring unit) 51, the engageable pawl member is shifted forwardly, and the pawl tip 15 on the top of the engageable pawl member 19 is pressed against the strapping band 9 (see an arrow C).

Figure 4:
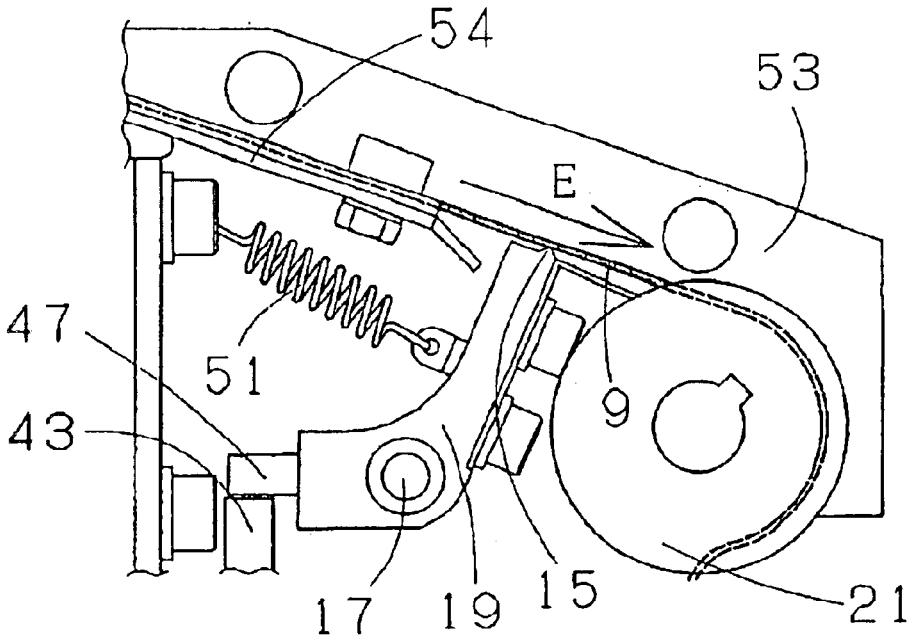
FIG. 4 is a schematic view showing how the engageable pawl member is operated, wherein the engageable pawl member allows a strapping band to move in a direction to pull back.

When the top end of the strapping band 9 has been held by the right gripper 27, and when the pawl tip 15 is pressed against the strapping band 9 by the forward shift of the engageable pawl member 19, the band driving roller 21 rotates in a clockwise direction in FIG. 2 (see an arrow D). When a force is applied to the pawl tip 15 in a direction to pull back, the engageable pawl member 19 is easily shifted backwardly so as to be out of the moving path for the strapping band 9 since the helical tension spring 51 has a comparatively weak spring force. As a result, the strapping band 9 is smoothly pulled back in contact with the pawl tip 15 to be wound around the article 5 (see FIG. 4, an arrow E indicating the moving direction of the strapping band 9). In this stage, the rear portion 47 of the engageable pawl member 19 is floating above the top end of the operable arm 43.

Figure 5:
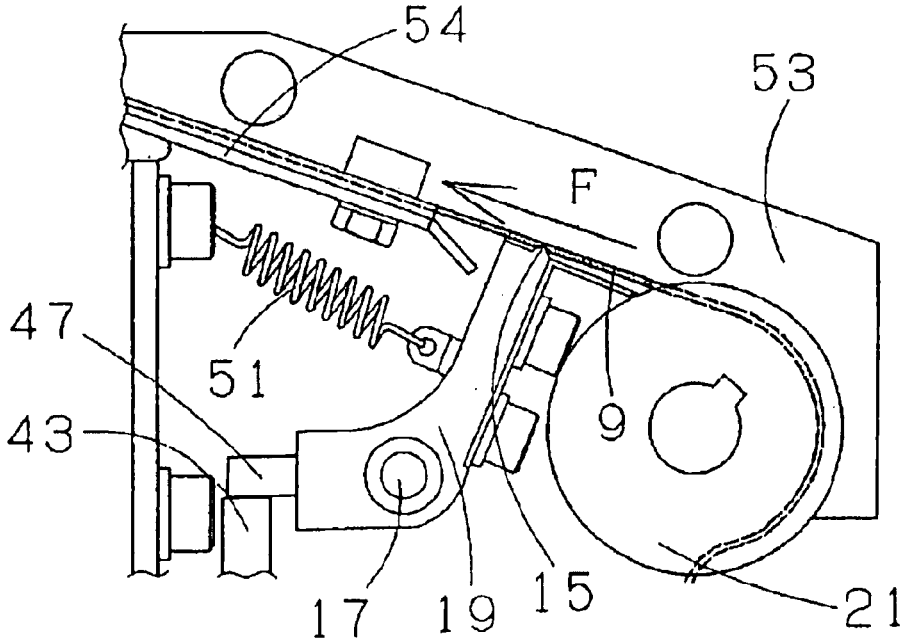
FIG. 5 is a schematic view showing how the engageable pawl member is operated, wherein the engageable pawl member prevents the strapping band from moving in a feeding direction.

When it is detected that the winding of the strapping band 9 around the article has been completed, the band driving roller 21 stop rotating, and the rocker roller 25 gets away from the band driving roller 21 by the release movement of the solenoid plunger 23. When the rocker roller 25 has gotten away from the band driving roller 21, the strapping band 9 is urged in the feeding direction since the strapping band is wound around the article, having a tensile force applied thereto. In this stage, the pawl tip 15 of the engageable pawl member 19 is pressed against and is engaged with the strapping band 9 by the tension action of the helical tension spring 15. As a result, the pawl tip 15 is drawn by the strapping band 9 to be forwardly shifted by the movement of the strapping band 9 in the feeding direction, shifting the engageable pawl member 19 forwardly. On the opposite side of the moving path for the strapping band 9, there is provided a holding guide 53 (a holding member), which extends from the band driving roller 21 to the sealer 13. The holding guide has an inner surface or lower surface provided so as to be in contact with the moving path for the strapping band 9 or form the moving path for the strapping band 9. Since the pawl tip 15 gradually projects into the moving path for the strapping band 9 to narrow the gap between the inner surface of the holing guide 53 and the pawl tip 15 as the engageable pawl member 19 is shifting forwardly, the strapping band 9 is sandwiched and held between the inner surface of the holing guide 53 and the pawl tip 15 by the forward shift of the engageable pawl member 19, preventing the strapping band 9 from being moved in the feeding direction (see FIG. 5; an arrow F indicating the moving direction of the strapping band 9). Even in this time, the rear portion 47 of the engageable pawl member 19 is slightly floating above the top end of the operable arm 43. When the engageable pawl member 19 is backwardly shifted, the pawl tip 15 shifts toward a direction away from the inner surface of the holding guide 53. The holding guide 53 has a lower plate 54 fixed thereon at a position ahead of the moving range of the pawl tip 15 on the top of the engageable pawl member 19. The lower plate 54 and the inner surface of the holding guide 53 form a narrow band path therebetween.

When the strapping band 9 is sandwiched between the engageable pawl member 19 and the holding guide 53 to be held in the feeding direction, the shaft for sealing 37 resumes continuous rotation at a constant speed to activate the left gripper 29 and the compression member 31 through the rotary movement of a holding cam 55 and a bonding cam 57, which are carried on the shaft for sealing 37. Just after the shaft for sealing 37 has resumed the rotation, the left gripper 29 is raised, being pushed up by the cam surface of the holding cam 55, to sandwich and hold a rear portion of the strapping band 9 along with the seal anvil 33. When the left gripper 29 has held the rear portion of the strapping band, the cam surface of the cam 41 has a convex portion 59 gotten in contact with the follower ring 45 of the operable arm 43, bringing back the operative arm 43 in an releasing state wherein the top end of the operable arm is located at an upper position. The top end of the operable arm 43, which has been brought back to the releasing state, get in contact with the rear portion 47 of the engageable pawl member 19 to push up the rear portion 47, backwardly shifting the engageable pawl member 19 so as to get the pawl tip 15 out of the moving path for the strapping band 9. Although a heater operating arm 61 for operating the heater 35 is urged toward the seal anvil 33 (an advancing direction) by a spring (not shown), the heater operating arm 61 is shifted toward the seal anvil 33 along the cam surface of a heater cam 63, which is carried on the shaft for sealing 37 and is rotated along with the rotation of the shaft for sealing 37. The heater 35 is advanced by the shift of the heater operating arm 61 toward the seal anvil 33 and gets into between the top end and the rear portion of the strapping band 9 (see an arrow G in FIG. 6).

When the shaft for sealing 37 is further rotated, the compression member 31 is raised, being pushed up by the cam surface of the bonding cam 57. The compression member presses the top end of the strapping band 9, the heater 35 and the rear portion of the strapping band 9 against the seal anvil 33 in overlapping fashion, cut the rear portion of the strapping band 9 and melt-bonds the top end and the rear portion of the strapping band. When the shaft for sealing 37 is further rotated, the compression member is slightly lowered, being drawn by a helical spring 65 along the cam surface of the bonding cam 57. Subsequently, the heater 35 is retracted so as to get out of between the top end and the rear portion of the strapping band 9 by the heater operating arm 61, which is pushed by the cam surface of the heater operating cam 63 to be shifted toward away from the seal anvil 33. When the shaft for sealing 37 is further rotated, the compression member 31 is raised again, being pushed by the cam surface of the bonding cam 57, to sandwich, press and melt-bond the molten top end and rear portion (rear side) of the strapping band 9 along with the seal anvil 33. When the shaft for sealing 37 is further rotated, the right gripper 27 (urged downwardly by a helical spring 67), the left gripper 29 (urged downwardly by a helical spring 69) and the compression member 31 are lowered along the cam surface of the securing cam 39, the cam surface of the holding cam 55 and the cam surface of the bonding cam 57. Additionally, the seal anvil 33 is retracted (see an arrow H in FIG. 6) by a band releasing arm 73, which is pushed by the cam surface of a band releasing cam 71 carried on the shaft for sealing 37 and is backwardly shifted against the spring force given by a helical spring (not shown). When the shaft for sealing 37 is further rotated to complete 360 degrees of rotation, the band releasing arm 73 is drawn by the helical spring to be shifted forwardly (in the direction opposite to the direction indicated by the arrow H in FIG. 6) along the cam surface of the band releasing cam 71. Thus, the seal anvil 33 is returned to the advancing position. When the seal anvil has been retracted, the strapping band 9 that has strapped the article is released from the sealer 13.

Figure 6:
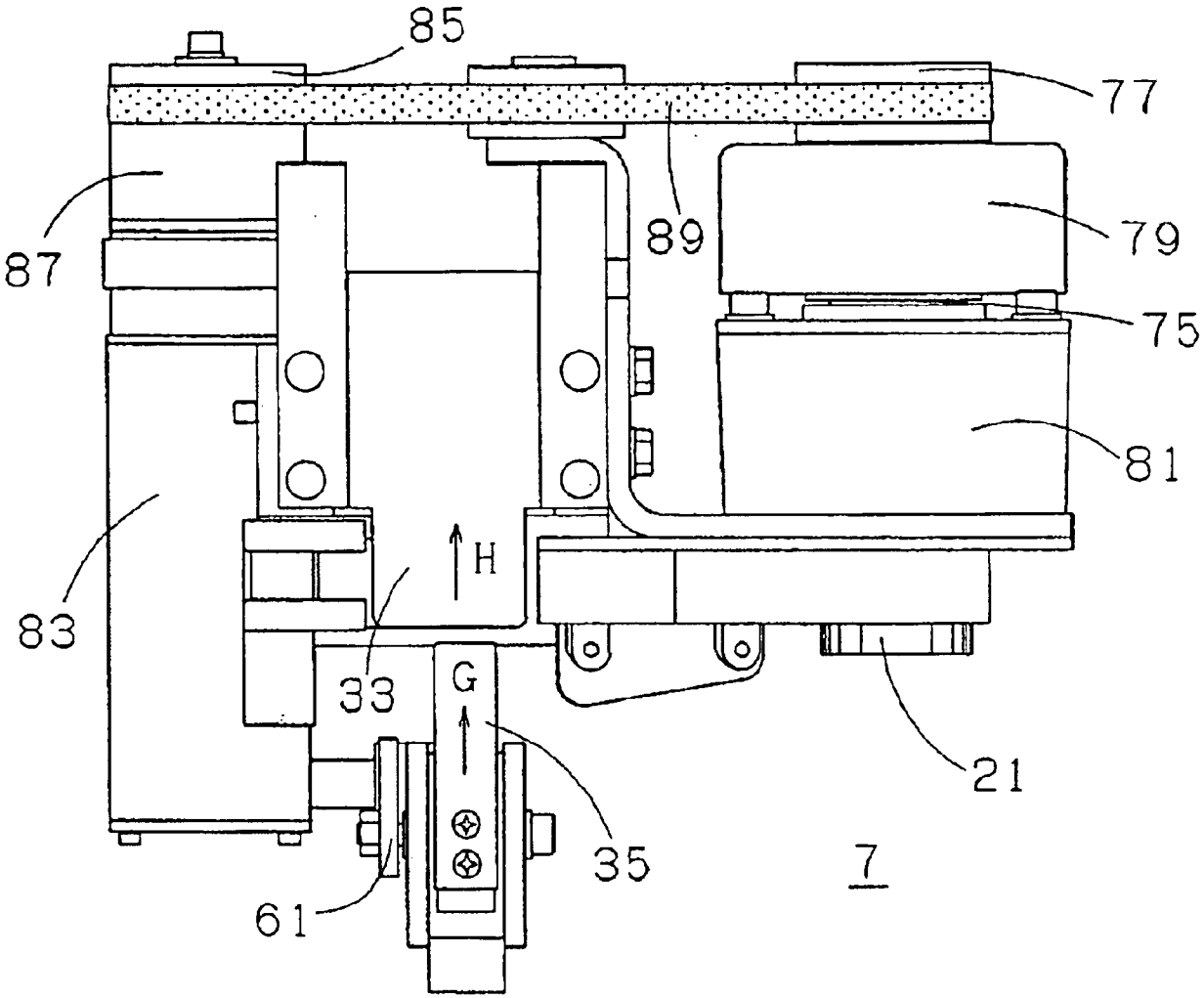
FIG. 6 is a plan view explaining a driving structure for a band driving roller unit and a shaft for sealing.

FIG. 6 is a plan view explaining a driving structure for the band driving roller unit 11 and the shaft for sealing 37.

The band driving roller 21 is coupled, through a reduction gear 81, to a d.c. motor 79, whose output shaft 75 has a pulley 77 extending around a rear portion thereof. There is provided an electromagnetic clutch 87, which has a pulley 85 and is located on a rear end of a driving shaft for sealing (not shown) housed in a casing 83. The driving shaft for sealing has a leading end connected to the shaft for sealing 37 in the casing 83, and the pulley 77 and the pulley 85 have a driving belt 89 extending therearound.

When the strapping band 9 is fed out, the d.c. motor 79 is rotated to rotate the band driving roller 21. At this time, the engageable pawl member 19 is located in the backwardly shifted position to get the pawl tip 15 on the top of the engageable pawl member 19 out of the moving path for the strapping band 9. At this time, the electromagnetic clutch 87 is disengaged. The rotation of the shaft for sealing 37 necessary for activating the right gripper 27 and the engageable pawl member 19 is carried out by transmitting a rotational force to the driving shaft for sealing from the d.c. motor 79 through the electromagnetic clutch 87 in engagement. When the strapping band 9 is drawn back, the d.c. motor is conversely rotated to rotate the band driving roller 21 in the opposite direction. At this time, the electromagnetic clutch 87 is disengaged. When it is detected based on the torque given to the d.c. motor 79 that the winding of the strapping band 9 around the article has been completed, the d.c. motor 79 stops the rotation. The cutting and melt-bonding operation for the strapping band 9 is carried out by transmitting a rotational force from the d.c. motor 79 to the driving shaft for sealing, inevitably the shaft for sealing 37, through the electromagnetic clutch 87 in engagement.

As explained above, the operable sealing mechanism for a strapping band according to the present invention can be operated by a single driving motor.

The entire disclosure of Japanese Patent Application No. 2002-50575 filed on Feb. 26, 2002 including specification, claims, drawings and summary is incorporated herein by reference in its entirety.

What is claimed is:

1. An operable sealing mechanism comprising:

a first gripper unit for holding a top end of a strapping band, which is annularly placed around an article to be strapped;

a band driving roller for feeding out the strapping band and winding the strapping band around the article by pulling back the strapping band to tension while the top end of the strapping band is held;

a second gripper unit for holding a rear portion of the strapping band wound around the article to keep the strapping band wound around the article; and a compression member for cutting the rear portion of the strapping band and pressing and bonding the top end and the rear portion together, the strapping band being kept wound;

the second gripper unit including an engageable pawl holding unit;

the engageable pawl holding unit comprising:

an engageable pawl member provided so as to be swingable along a feeding path of the strapping band;

a holding member provided on an opposite side of the engageable pawl member across the feeding path of the strapping band; and a spring unit having a spring directly connected to and urging the engageable pawl member forwardly in a feeding direction of the feeding path so as to press a pawl tip of the engageable pawl member against the strapping band;

wherein the engageable pawl member allows the strapping band to be pulled back and prevents the strapping band from being fed out in the feeding direction by sandwiching and holding the strapping band between the engageable pawl member and the holding member when a force for feeding the strapping band in the feeding direction is applied to the strapping band.

2. The operable sealing mechanism according to claim 1, wherein the first gripper and the compression member are configured to be operated by a holding cam and a bonding cam, respectively, which are carried on a shaft for scaling; and the shaft for sealing is configured to be rotated by use of a band driving motor as a driving force, the band driving motor rotating the band driving roller.

3. An operable sealing mechanism comprising:

a first gripper for holding a top end of a strapping band, which is annularly placed around an article to be strapped;

a band driving roller for feeding out the strapping band and winding the strapping band around the article by pulling back the strapping band to tension while the top end of the strapping band is held;

a second gripper for holding a rear portion of the strapping band wound around the article to keep the strapping band wound around the article; and a compression member for cutting the rear portion of the strapping band and pressing and bonding the top end and the rear portion together, the strapping band being kept wound;

an engageable pawl holding unit further provided on a rear side of the second gripper;

the engageable pawl holding unit comprising:

an engageable pawl member provided so as to be swingable along a feeding path of the strapping band;

a holding member provided on an opposite side of the engageable pawl member across the feeding path of the strapping band; and a spring unit having a spring directly connected to and urging the engageable pawl member forwardly in a feeding direction of the feeding path so as to press a pawl tip of the engageable pawl member against the strapping band;

wherein the engageable pawl member allows the strapping band to move in a direction to pull back and prevents the strapping band from being fed out in the feeding direction by sandwiching and holding the strapping band between the pawl tip and the holding member when a force for feeding the strapping band in the feeding direction is applied to the strapping band.

4. The operable sealing mechanism according to claim 3, wherein the second gripper and the compression member are configured to be operated by a holding cam and a bonding cam, respectively, which are carried on a shaft for sealing; and the shaft for sealing is configured to be rotated by use of a band driving motor as a driving force, the band driving motor rotating the band driving roller.

* * * * *